United States Patent [19]

Goldsby

[11] Patent Number: 4,499,644

[45] Date of Patent: Feb. 19, 1985

[54] APPARATUS FOR REPLACING A CHAIN

[76] Inventor: George M. Goldsby, Rte. 1, Ripley, Tenn. 38063

[21] Appl. No.: 517,399

[22] Filed: Jul. 26, 1983

[51] Int. Cl.[3] ..... B25B 27/14

[52] U.S. Cl. ..... 29/281.6

[58] Field of Search ..... 254/231, 232, 389, 398, 254/394; 474/130; 81/3 R; 29/281.6, 270, 271; 269/25

[56] References Cited

U.S. PATENT DOCUMENTS

| | | | |
|---|---|---|---|
| 721,946 | 3/1903 | Foster | 254/231 |
| 1,638,432 | 8/1927 | Connors | 254/231 |
| 1,770,763 | 7/1930 | Wolfstyn | 269/25 |
| 4,218,939 | 8/1980 | Castoe | 29/281.6 |
| 4,373,240 | 2/1983 | Castoe | 29/281.6 |

*Primary Examiner*—Robert C. Watson

*Attorney, Agent, or Firm*—Robert C. Sullivan

[57] ABSTRACT

A tool or fixture for use in replacing a chain, and a method of chain replacement using the tool or fixture, comprising a shroud member adapted to be detachably mounted outwardly of and in closely spaced chain guiding relation to an accessible portion of the normal path of movement of the chain so as to provide an outer bounding and retaining surface for said accessible portion of the chain path. An access opening is provided in the shroud member to permit connection of the new or replacement chain in series with the chain being removed, and to permit inward feeding movement through the access opening of the new chain and discharging movement through the access opening of the old chain. A further feature of the construction is the provision of means such as pivotally mounted angularly adjustable rollers supported by the shroud contiguous the access opening for applying an adjusted degree of tension to both the old and new chains during the chain replacement procedure. The tool and method of the invention, although not restricted to such use, have particular utility in connection with the replacement of a timing chain on an overhead cam engine.

10 Claims, 5 Drawing Figures

APPARATUS FOR REPLACING A CHAIN

BACKGROUND OF THE INVENTION

1. Field of the Invention

This invention relates to a jig, fixture, or tool for use in removing an old or worn chain from an apparatus with which it is engaged and for replacing the worn chain with a new chain. The device of the invention, while not restricted to such use, will be described as embodied for use in connection with the replacement of a timing chain of an internal combustion engine, particularly an internal combustion engine of the overhead cam type.

2. Description of the Prior Art

It has been known in the prior art relating to chain replacement, such as the replacement of timing chains on internal combustion engines of the overhead cam type, for example, to disconnect the old or worn chain intermediate of its length, while the old chain is still in place about the various sprockets which it usually engages, and to connect the new chain in series with the old chain by means of a detachable master link at the leading end of the new chain, with the opposite end of the master link being connected to the trailing end of the old chain. The crankshaft of the engine is then manually rotated to cause both the new and old chains to be pulled along the chain path about the various toothed sprockets along the path of movement of the chains until the entire length of the new chain has been pulled into the chain path, and the entire length of the old chain has exited or been discharged from the chain path, at which time the old chain is disconnected from the new chain and the two ends of the new chain are connected together by means of the master link to thereby complete the installation of the new chain. The prior art method of removing an old chain and replacing it with a new chain as just briefly described has various problems which have made it an unsatisfactory method of replacing the old chain with the new chain.

Thus, for example, the prior art method of chain replacement as just briefly described is very time consuming and normally requires the use of at least two persons to perform the chain replacement operation. Furthermore, when the chain which is being replaced is the timing chain of an internal combustion engine which drives the cam shaft of the internal combustion engine, the manual replacement process hereinbefore described makes it very difficult to insure that the proper timed relation is maintained between the cam shaft and the pistons of the internal combustion engine since if any slippage occurs during the manual chain replacement process hereinbefore described, the timed relation between the cams which control the fuel inlet and exhaust valves of the engine and the pistons of the engine may be lost.

Furthermore, in the prior art manual chain replacement method hereinbefore described, the extensive direct contact of the workmen with the chain sprockets and with the chain may at times present safety hazards resulting in injury to the operating personnel. Also, the prior art method of manually replacing the chain can possibly cause damage to the engine or other machine on which the chain is being replaced and/or to the chain itself. In the prior art method of chain replacement, it is possible for the chain to become disengaged from the drive sprocket on the crankshaft, in which case it is very difficult and time consuming to re-engage the chain with the crankshaft drive sprocket.

Although an extensive search was made through the records at the U.S. Patent and Trademark Office, no patent or other publication was noted which appears to be pertinent with respect to applicant's invention which relates to a tool or fixture for use in the in situ replacement of an old, or worn chain with a new chain.

STATEMENT OF THE INVENTION

Accordingly, it is an object of the present invention to provide a tool or fixture for use with and as an aid in connection with the in situ replacement of an old or worn chain with a new chain without disturbing the relationship of the various members which are operatively related by the chain.

It is a further object of the invention to provide a tool or fixture for use in replacing a worn chain, such as timing chain of an internal combustion engine or the like, with a new c hain, in which the chain replacement procedure can be accomplished in a substantially shorter time than in accordance with the prior art method of chain replacement.

It is another object of the invention to provide a tool or fixture for use in connection with the replacement of a worn chain with a new chain which permits the chain replacement to be accomplished by a single mechanic or workman rather than requiring the use of several workmen as in the prior art method of chain replacement.

It is still a further object of the invention to provide a tool or fixture for use in connection with chain replacement and having particular utility in connection with the replacement of a timing chain of an internal combustion engine, in which the timed relation between the various components of the apparatus which are operatively related with the chain are maintained in a fixed unchanging timed relation during the chain replacement procedure.

It is still a further object of the invention to provide a tool or fixture for use in connection with chain replacement which substantially eliminates safety hazards to personnel and to equipment which were to some degree inherent in the prior art method of chain replacement.

In achievement of these objectives, there is provided in accordance with the invention a tool or fixture for use in replacing a chain, comprising a shroud member adapted to be detachably mounted outwardly of and in closely spaced chain guiding relation to an accessible portion of the normal path of movement of the chain so as to provide an outer bounding and retaining surface for said accessible portion of the chain path. An access opening is provided in the shroud member to permit connection of the new or replacement chain in series with the chain being removed, and to permit inward feeding movement through the access opening of the new chain and exiting or discharging movement through the access opening of the old or worn chain. A further feature of the construction is the provision of means such as pivotally mounted angularly adjustable rollers supported by the shroud contiguous the access opening for applying an adjusted degree of tension to both the old and new chains during the chain replacement procedure. The tool of the invention, although not restricted to such use, has particular utility in connection with the replacement of a timing chain on an overhead cam engine.

Further objects and advantages of the invention will become apparent from the following description taken in conjunction with the accompanying drawing in which:

DESCRIPTION OF THE PREFERRED EMBODIMENT

Figure 1:
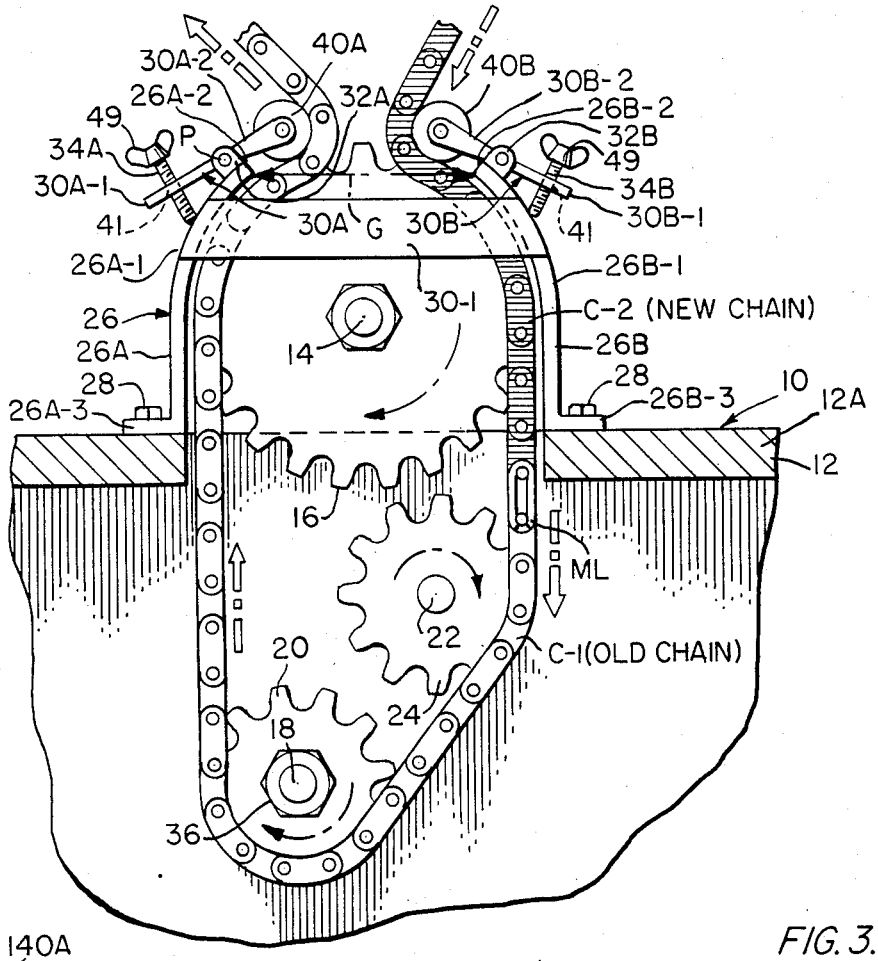
FIG. 1 is a view in elevation, and partially in section, showing the chain replacement tool or fixture of the invention mounted on the upper surface of the cylinder head of an internal combustion engine of the overhead cam type.

Referring now to FIG. 1, there is shown in fragmentary view an internal combustion engine generally indicated at 10 of the overhead cam type, including a cylinder head 12. A typical overhead cam engine of the type to which the chain replacement fixture of the present invention might be applied is shown, for example, by U.S. Pat. Nos. 4,218,939—Castoe and 4,373,240—Castoe. A cam shaft 14 for the overhead type cams is mounted for rotation about a horizontal axis lying above the plane of upper surface 12A of cylinder head 12. A sprocket 16 is secured to and rotates with cam shaft 14. A crankshaft 18 is mounted for rotation about a horizontal axis located in the crankcase of the engine block. A sprocket 20 is secured to and rotates with crankshaft 18. An auxiliary drive shaft 22 having a sprocket 24 secured thereto is suitably mounted for rotation at a location above the level of crankshaft 18. The auxiliary shaft 22 is used for driving some auxiliary device, such as a water pump, for example.

During the normal operation of the engine, and before the beginning of the chain replacement procedure, the old or worn chain indicated at C-1 is trained in an endless loop about the three sprockets 16, 20, and 24, whereby rotation of crankshaft 18 causes rotation of cam shaft 14 and of auxiliary drive shaft 22.

The tool or fixture of the invention is directed toward a new and unique solution of the problem of the in situ replacement of the old chain C-1 with a new chain C-2 while at all times maintaining proper tension of the new and old chains during the replacement procedure so as to insure maintenance of proper timed relation of the chains to the sprockets 16, 20, and 24 and to the components of the engine assembly which are operatively connected to sprockets 16, 20 and 24.

The tool or fixture which is used as an aid in replacing chains in accordance with the invention is generally indicated at 26 and comprises a guard or shroud-like member which is adapted to be detachably mounted on the upper surface of cylinder head 12 a short distance laterally outwardly and in closely spaced relation to the path of movement of the chain as it passes circumferentially downwardly and circumferentially upwardly on the oppositely disposed portions of the periphery of upper sprocket 16. The shroud-like member 26 may be made of a suitable metal such as aluminum or steel, for example, and may also be made of any other suitable material such as hard plastic, for example.

Fixture 26 includes a first shroud portion 26A and an oppositely-disposed second shroud portion 26B. The two shroud portions 26A and 26B are connected together at the upper portions thereof by frame members 30-1 and 30-2, respectively, which are each suitably secured in bridging relation to oppositely disposed shroud portions 26A, 26B. One of the frame members 30-1 or 30-2 is secured to the "front" end of the fixture 26 while the other frame member 30-1 or 30-2 is secured to the "rear" end of the fixture 26. The "front" and "rear" ends of fixture 26 are spaced from each other in a direction which extends axially of cam shaft 14.

The respective opposite shroud portions 26A and 26B have a contour which conforms generally to the path of movement of the chain as it passes around the upper sprocket 16, as seen in FIG. 1. Thus, the lower portion of each of the respective shroud portions 26A, 26B is essentially vertical from the level of the upper surface 12A of cylinder head 12 to the level of the horizontal axis of cam shaft 14. Above the level of the horizontal axis of cam shaft 14, the respective oppositely disposed shroud portions curve inwardly toward each other as indicated at 26A-1, 26B-1 to conform to the inwardly converging path of the opposite ends of the chain path contiguous the upper portion of sprocket 16.

Figure 2:
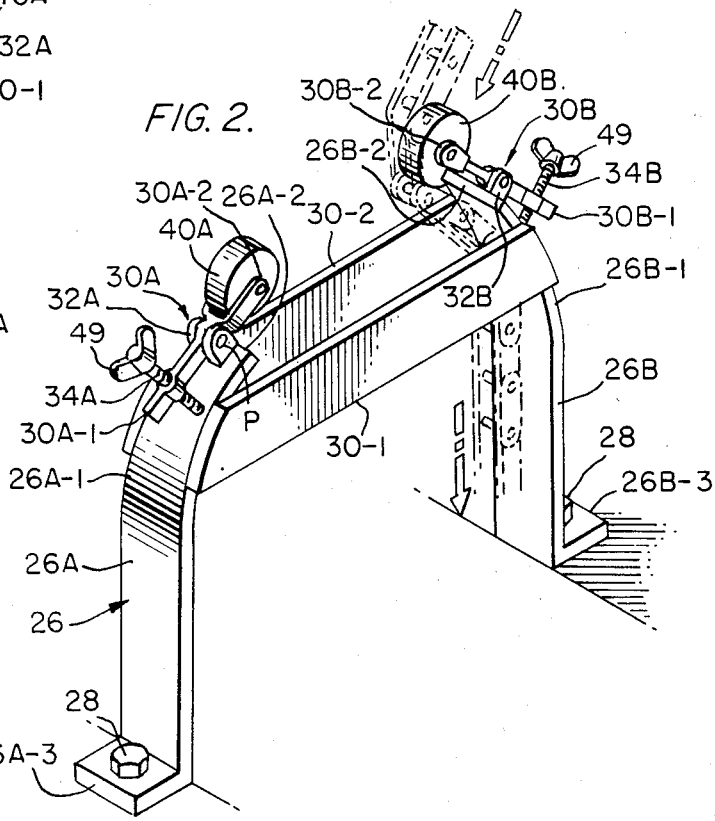
FIG. 2 is a perspective view of the chain replacement fixture of FIG. 1.
Figure 3:
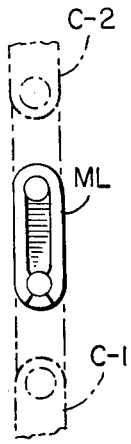
FIG. 3 is a detail view showing the connection of the master link of the chain to two chain ends. During the chain replacement operation, the master link connects the trailing end of the old chain to the leading end of the new chain, as seen in FIG. 1; and after the completion of the chain replacement operation, the master link is used to connect the two opposite ends of the new chain.

As seen in FIGS. 1 and 2, the upper ends of the respective shroud portions 26A, 26B terminate at end edges 26A-2, 26B-2, respectively, to leave a substantial circumferential gap or access opening in the shroud 26, as indicated at G in FIG. 2, between the facing ends 26A-2 and 26B-2 to permit entrance through the gap of the new chain C-2 and to permit the exit or discharge therethrough of the old chain C-1. For example, the angle subtended between the end edge 26A-2 of shroud portion 26A and the vertical axis of sprocket 16 may be approximately 45°; and, similarly, the angle subtended between the end edge 26B-2 of shroud portion 26B and the central vertical axis of sprocket 16 may be approximately 45°. Therefore, in this assumed example, the spacing which defines the gap between the end edges 26A-2 and 26B-2 may be approximately 90° with respect to the periphery or circumference of the upper sprocket 16 as seen in FIG. 1. The angular values just given are merely by way of example and are not intended to be limiting.

The lower end of each of the respective shroud portions 26A, 26B is provided with a horizontal flange portion respectively indicated at 26A-3, 26B-3. The respective flange portions 26A-3 and 26B-3 are provided with apertures to receive bolts 28 by means of which the shroud or guard 26 is detachably secured to the cylinder head 12.

While shroud 26 has been shown in FIGS. 1 and 2 as being detachably secured to cylinder head 12 by bolts 28, the shroud 26 may be detachable secured to cylinder head 12 by other means such as by suitable clamps, for example.

A further feature of the construction is the provision of oppositely disposed roller subassemblies respectively generally indicated at 30A, 30B which are secured to the upper ends of the respective shroud portions 26A, 26B contiguous the gap G, as best seen in the views of FIGS. 1 and 2.

To support the respective roller subassemblies, a corresponding clevis 32A, 32B is rigidly mounted or otherwise provided on each of the respective shroud portions 26A, 26B contiguous the respective ends edges 26A-2, 26B-2. Each of the roller subassemblies comprises a corresponding lever arm 30A-1, 30B-1, each lever arm being mounted for pivotal movement intermediate its length about a pivotal axis P on the corresponding clevis 32A or 32B. Each of the lever arms 30A-1, 30B-1 terminates at its end thereof which is closest to the gap G between the two shroud portions 26A, 26B with a clevis or forked end 30A-2, 30B-2 which supports an axle, shaft, or the like on which the corresponding roller member 40A, 40B is mounted. The respective roller members are mounted for rotation relative to the forked ends 30A-2, 30B-2. Each of the roller members is preferably made of rubber or of elastomeric material. The shaft or axle on which each roller is mounted is preferably made of steel.

As best seen in the view of FIG. 1, means is provided on the opposite portion of each of the respective lever arms 30A-1, 30B-1 for adjusting the angular position of the respective lever arm and of the roller carried thereby about the pivotal axis P of the clevis such as 32A, 32B on which the lever arm is pivotally mounted. This permits adjustment of the angular position of the rollers relative to the respective ends of the new chain C-1 and the old chain C-2, and thus to control the tension on the chains C-1 and C-2. For this purpose each of the respective lever arms 30A-1 and 30B-1 is provided with a threaded passage 41 therein which receives a corresponding threaded adjusting screw member 34A or 34B.

The lower end of each threaded adjusting screw member 34A, 34B normally bears against the outer surface of the corresponding shroud portion 26A or 26B. Each adjusting screw is provided at its upper end with a wing portion 49 which can be manually engaged by the operator to rotate the adjusting screw in the threaded passage in lever arm 30A-1 or 30B-1. It can be seen that if the lower end of the adjusting screw is already contacting the surface of the shroud and is rotated in a threading direction relative to the threaded passage in the lever arm that the lever arm 30A-1 (on the left in FIG. 1) will advance upwardly as viewed in FIG. 1 along the threaded screw and thus cause lever 30A-1 to swing in a clockwise direction about its pivotal support to move the corresponding roller 40A downwardly to exert pressure on the old chain C-1 to thereby increase the tension in the old chain. Similarly, the adjusting screw for the roller subassembly on the right-hand side of FIG. 1 may be rotated in the threaded passage in lever arm 30B-1 to cause lever arm 30B-1 to advance upwardly, as viewed in FIG. 1, along the threaded screw member, thus causing lever 30B-1 to swing in a counterclockwise direction as viewed in FIG. 1 to cause roller 40B to exert a desired pressure on new chain C-2 to thereby increase the tension on the new chain to a desired value. By increasing the tension on the chains C-1 and C-2 as just described to a required adjusted value, the chains will remain in contact with the sprockets along the chain path, thereby insuring that proper timed relation is maintained between the sprockets 16, 20 and 24 during the chain replacement procedure.

Figure 4:
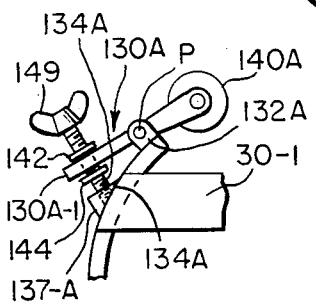
FIG. 4 is a fragmentary enlarged view of the roller subassembly on one side of the shroud using a modified type of adjusting arrangement for the roller; and, FIG. 5 is a view in section along line 5—5 of FIG. 4 showing a detail of the elongated opening in the lever arm through which the threaded stud member passes.
Figure 5:
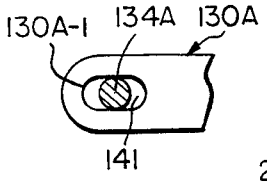

Referring now to FIGS. 4 and 5, there is shown a roller subassembly 130A having a modified type of adjusting arrangement as compared to the adjusting arrangement shown in the embodiment of FIGS. 1 and 2. In the modified arrangement shown in FIGS. 4 and 5, only one roller and its adjusting arrangement are shown. However, it will be understood that both of the chain tensioning rollers may be constructed as shown in this modified embodiment.

As seen in FIG. 5, the lever arm 130A-1 is provided with an elongated unthreaded passage or slot 141 therein which freely receives a threaded stud member 134A. The elongated slot 141 accommodates arcuate movement of lever arm 130A-1 relative to stud 134A. Threaded stud member 134A threadedly engages nut member 137A which is rigidly secured, as by welding, to the outer surface of the upper portion of shroud 30A in line with the axis of the stud member. Stud member 134A carries an upper abutment member 142 which lies above the level of lever arm 130A-1, and also carries a lower abutment member 144 which is carried by the stud member at a level below the lever arm 130A-1. The abutment members 142 and 144 may be annular washers which are suitably fixed to each of the stud members. Thus, when stud member 134A is turned in a direction which causes the stud member to move inwardly into threaded engagement with nut member 137A, the upper abutment 142 carried by the stud member engages the upper surface of lever arm 130A-1 and causes the lever arm and the roller 140A carried thereby to swing about the pivot point P of pivotal support 132A in a counterclockwise direction as viewed in FIG. 4, and thus in a direction away from the gap G. On the other hand, when the threaded stud member 134A is rotated in an unthreading direction relative to nut member 137A, the lower abutment member 144 carried by the stud member abuts against the under surface of lever 130A-1 to cause the lever to move about the pivot point P in a clockwise direction as viewed in FIG. 4 to thereby cause roller 140A to move in a direction toward gap G which applies force to the chain to cause increased tension to be applied to the chain. Thus, by controlling the direction of rotation of the threaded stud member, the direction and magnitude of angular movement of roller 140A about the pivotal axis P can be adjusted to thereby adjust the tension on the chain during the chain replacement procedure.

The stud member 134A has fixed to the normally upper end thereof a wing portion 149 which may be manually engaged by the operator to rotate the stud member in the threaded passage of nut member 137A.

METHOD OF OPERATION

It will be assumed that before the chain replacement procedure begins, the old chain C-1 is in the form of a closed engless loop which passes around the three sprockets 16, 20 and 24 as shown in FIG. 1. It will also be assumed that the two ends of the old chain C-1 are connected together by a detachable master link ML. Master links are well known in the arts of chain manufacture and repair for connecting two ends of a chain, and are shown, for example by U.S. Pat. Nos. 3,854,282—Mazel; 3,885,445—Montano; 3,939,721—Juenzig et al; and 4,043,215—Long et al.

To being the chain replacement procedure, the shroud member 26 is positioned as shown in FIG. 1 in which the shroud is detachably secured to the upper end of cylinder head 12 by means of threaded bolt members 28 which pass through corresponding apertures in horizontal flanges 26A-3 and 26B-3 of the shroud, the bolts 28 engaging corresponding threaded passages in the upper end of cylinder head 12. The engine is then manually rotated in a suitable manner such as by means of a suitable wrench which engages nut 36 on crankshaft 18 whereby to cause old chain C-1 to move about the chain path to a position where the master link is accessible at the gap or access opening G (FIG. 2) between the two facing ends 26A-3, 26B-3 of the respective shroud portions 26A, 26B. With the master link ML of the old chain located in the gap G, the old master link may continue to be used during the chain replacement procedure, in which case the old master link is detached from the leading end of the old chain (relative to the direction of chain rotation) at gap G to thereby break the endless loop of the old chain. The old master link remains connected at one of its ends to what becomes the trailing end of the old chain during the chain replacement procedure. The leading end of the new chain is then connected to the opposite end of the old master link. Thus, during the chain replacement procedure, the old master link connects the trailing end of the old chain in series with the leading end of the new chain which is in the process of being installed. The new chain may be lubricated before beginning the chain replacement procedure.

Crankshaft 18 is then further manually rotated by the engagement of the suitable wrench or the like with nut 36 on crankshaft 18 to cause the old chain C-1 to move in a clockwise direction as viewed in FIG. 1 about the path of chain movement as defined by the sprockets 16, 20 and 24. The new chain C-2 is pulled into the gap G at the upper end of the shroud, the new chain then moving into and downwardly along the chain path defined by the upper portion of sprocket 16 and by the inner surface of the shroud portion 26B. As it passes upwardly around sprocket 16 toward th exit provided by gap G, the old chain C-1 is guided by the opposite shroud portion 26A. The old chain C-2 passes upwardly and outwardly through gap G as best seen in the view of FIG. 1. The rubber rollers 40A, 40B carried by the pivotally mounted lever arms bear against the outer peripheries of the new chain C-2 and of the old chain C-1 to maintain proper tension on the old and new chains during the chain replacement procedure whereby to insure that the old and new chains remain in proper tensioned engagement with the respective sprockets 16, 20 and 24 about which the chains pass during their movement. The angular position of rollers 40A, 40B may be adjusted to adjust the tension of chains C-1, C-2 by adjusting the threaded adjusting screw members 34A, 34B (FIGS. 1 and 2) to thereby adjust the angular position of lever arms 30A-1, 30B-1 on which rollers 40A, 40B are mounted. In the modified adjusting arrangement shown in FIGS. 4 and 5, the angular position of each roller may be adjusted by adjusting a threaded stud member such as 134A of FIGS. 4 and 5 relative to a nut member such as nut member 137A of FIG. 4, to selectively cause abutment 142 or 144 to engage the lever arm 130A-1 to cause swinging movement of lever arm 130A-1 about the pivot point P of FIG. 4.

When the old chain C-1 has substantially completely emerged from the upper end of shroud 26 and the new chain C-2 has substantially completely entered the upper end of shroud 26, the old master link ML will be at the upper end of the shroud contiguous the gap G. At this point, the old master link, which is still connected at the leading end thereof to the trailing end of the old chain C-1 and at the trailing end thereof to the leading end of the new chain C-2 is disconnected from both the old and the new chains. A new master link is then connected between the two opposite ends of the new chain. The old chain will then have been completely removed from engagement with the sprockets and may then be removed and discarded.

With the connection of the new master link to the two opposite ends of the new chain, the chain replacement operation will have been completed and the shroud member 26 may then be removed from its detachable connection to cylinder head 12 by removing bolts 28 or other detachable connecting means from their connection to the cylinder head 12 and then removing shroud 26 from its overlying relation to the chain path and to the cylinder head.

While the old chain has been described as having the two ends thereof connected by a detachable master link before the beginning of the chain replacement procedure, many chains have all of the links connected together by riveted members and do not include a detachable link such as the "master link" as part of the chain assembly. In the case where the old chain does not include a detachably removable master link, any one of the links of the old chain may be removed prior to the beginning of the chain replacement procedure by grinding off the heads of the rivets of one of the links and removing that link from the old chain. A master link may then be substituted in place of the link which has just been removed. One end of the master link may be detachably connected to the trailing end of the old chain with the opposite end of the master link being connected to the leading end of the new chain, as previously described.

While there has been shown and described a particular embodiment of the invention, it will be obvious to those skilled in the art that various changes and modifications may be made therein without departing from the invention and, therefore, it is aimed to cover all such changes and modifications as fall within the true spirit and scope of the invention.

The embodiments of the invention in which an exclusive property or privilege is claimed are defined as follows:

1. A fixture for use in removing a worn chain and for replacing said worn chain with a replacement chain, said fixture comprising a shroud member adapted to be detachably mounted outwardly of and in closely spaced chain guiding relation to at least an accessible portion of the chain path so as to provide an outer bounding and retaining means for a chain moving along said portion of said path, said chain path extending about at least two sprockets, and in which said shroud includes a first shroud portion mounted contiguous the chain path about a first portion of one of said sprockets, and a second shroud portion mounted contiguous said chain path about another portion of said one sprocket, an access opening in said shroud member to permit connection of said replacement chain in series with said worn chain, to permit inward feeding through said access opening of the series connected replacement chain, and to permit discharge through said access opening of said worn chain, said access opening being located between said first and said second shroud portions, and means connecting said first and said second shroud portions to each other.

2. A fixture as defined in claim 1 which is adapted to be mounted on the upper surface of the cylinder head of an internal combustion engine of the overhead cam type and in closely spaced relation to the path of a chain projecting above said upper surface, and in which said worn chain and said replacement chain are timing chains on said internal combustion engine.

3. A fixture as defined in claim 1 comprising means mounted on said shroud contiguous said access opening for applying tension to said chains during the chain replacement procedure.

4. A fixture as defined in claim 3 in which said means for applying tension to said chains comprises a first and a second roller respectively mounted on said shroud contiguous opposite sides of said access opening for respectively applying tension to the replacement chain entering said access opening and for applying tension to said worn chain being discharged through said access opening.

5. A fixture as defined in claim 4 in which said rollers are separately adjustably mounted whereby to permit adjustment of the tension on the respective chains.

6. A fixture as defined in claim 4 in which each roller is mounted on a corresponding lever arm, each roller extending into overlying relation to said access opening whereby each of said chains passes around a corresponding one of said rollers in passing through said access opening of said shroud, each of said lever arms being pivotally supported on said shroud contiguous said access opening whereby to permit angular adjustment of each lever arm and the roller mounted thereon relative to the chain passing about the respective rollers, and means for adjusting the angle of each of said lever arms; whereby to adjust the tension applied by the corresponding rollers to the respective chains.

7. A fixture for use in removing a worn chain and for replacing said worn chain with a replacement chain, said fixture comprising a shroud member adapted to be detachably mounted outwardly of and in closely spaced chain guiding relation to at least an accessible portion of the chain so as to provide an outer bounding and retaining means for a chain moving along said portion of said path, an access opening in said shroud member to permit connection of said replacement chain in series with said worn chain, said access opening also permitting inward feeding through said access opening of said series-connected replacement chain and permitting discharge through said access opening of said worn chain, means mounted on said shroud contiguous said access opening for applying tension comprising a first and a second roller respectively mounted on said shroud contiguous opposite sides of said access opening for respectively applying tension to said replacement chain entering said recess opening and for applying tension to said worn chain being discharged through said access opening, and means for separately adjusting each of said rollers to permit adjustment of the tension on the respective chains.

8. A fixture as defined in claim 7 in which said access opening is in the upper end of said fixture.

9. A fixture as defined in claim 7 in which said chain path extends about at least two sprockets, and in which said shroud includes a first shroud portion mounted contiguous the chain path about a first portion of one of said sprockets, and a second shroud portion mounted contiguous the chain path about another portion of said one sprocket, said first and said second shroud portions being positioned in oppositely disposed relation to each other, said access opening being located between said first and said second shroud portions, and means connecting said first and said second shroud portions to each other.

10. A fixture as defined in claim 7 which is adapted to be mounted on the upper surface of the cylinder head of an internal combustion engine of the overhead cam type and in closely spaced relation to the path of a chain projecting above said upper surface, and in which said worn chain and said replacement chain are timing chains on said internal combustion engine.

* * * * *